US008662069B2

(12) United States Patent
Gasparini et al.

(10) Patent No.: US 8,662,069 B2
(45) Date of Patent: Mar. 4, 2014

(54) COOKING TOP WITH GAS BURNER COMPRISING A SEMI-PERMEABLE ELEMENT

(75) Inventors: Alberto Gasparini, Fabriano (IT); Silvio Corrias, Moncalvo (IT); Luisa d'Alessandro, Scanno (IT); Paolo Santonicola, Fabriano (IT)

(73) Assignee: Indesit Company S.P.A., Fabriano (IT)

( * ) Notice: Subject to any disclaimer, the term of this patent is extended or adjusted under 35 U.S.C. 154(b) by 182 days.

(21) Appl. No.: 11/992,694

(22) PCT Filed: Jul. 28, 2006

(86) PCT No.: PCT/IB2006/002073
§ 371 (c)(1),
(2), (4) Date: Mar. 27, 2008

(87) PCT Pub. No.: WO2007/036772
PCT Pub. Date: Apr. 5, 2007

(65) Prior Publication Data

US 2009/0277439 A1 Nov. 12, 2009

(30) Foreign Application Priority Data

Sep. 30, 2005 (IT) ..... TO2005A0685

(51) Int. Cl.
*F24C 3/02* (2006.01)

(52) U.S. Cl.
USPC ..... 126/39 H; 126/39 J; 126/39 K

(58) Field of Classification Search
USPC ..... 431/329, 328; 126/39 J, 43–49, 39 H
See application file for complete search history.

(56) References Cited

U.S. PATENT DOCUMENTS

| | | | | | |
|---|---|---|---|---|---|
| 1,223,308 | A | * | 4/1917 | Bone | 431/328 |
| 1,238,632 | A | * | 8/1917 | Caister | 431/210 |
| 1,436,383 | A | * | 11/1922 | Coley et al. | 431/207 |
| 1,737,911 | A | * | 12/1929 | Birch | 431/216 |
| 1,887,330 | A | * | 11/1932 | Shaw | 431/353 |
| 1,903,032 | A | * | 3/1933 | Dufault | 431/198 |

(Continued)

FOREIGN PATENT DOCUMENTS

| | | |
|---|---|---|
| AU | 412372 B2 | 4/1971 |
| BE | 547098 | 12/1959 |

(Continued)

OTHER PUBLICATIONS

U.S. Appl. No. 12/528,371, filed Aug. 26, 2009 by Tiziano Lacche' entitled Gas Burner System for Food Cooking Appliances, 15 pages.

(Continued)

*Primary Examiner* — Kenneth Rinehart
*Assistant Examiner* — Jorge Pereiro
(74) *Attorney, Agent, or Firm* — Cesari and McKenna, LLP

(57) ABSTRACT

The present invention relates to a cooking top (1), in particular adapted to be used in a household environment, comprising at least one gas burner (40) which can be used with at least one fuel gas. The cooking top also comprises flame divider means (9) associated with the gas burner (40) and comprising at least one semi-permeable element (90), which is permeable to gaseous substances and substantially impermeable to liquid substances. The semi-permeable element (90) may be a micro-perforated sheet, a fibrous membrane, or a porous membrane.

19 Claims, 6 Drawing Sheets

(56) References Cited

U.S. PATENT DOCUMENTS

Figure 1:
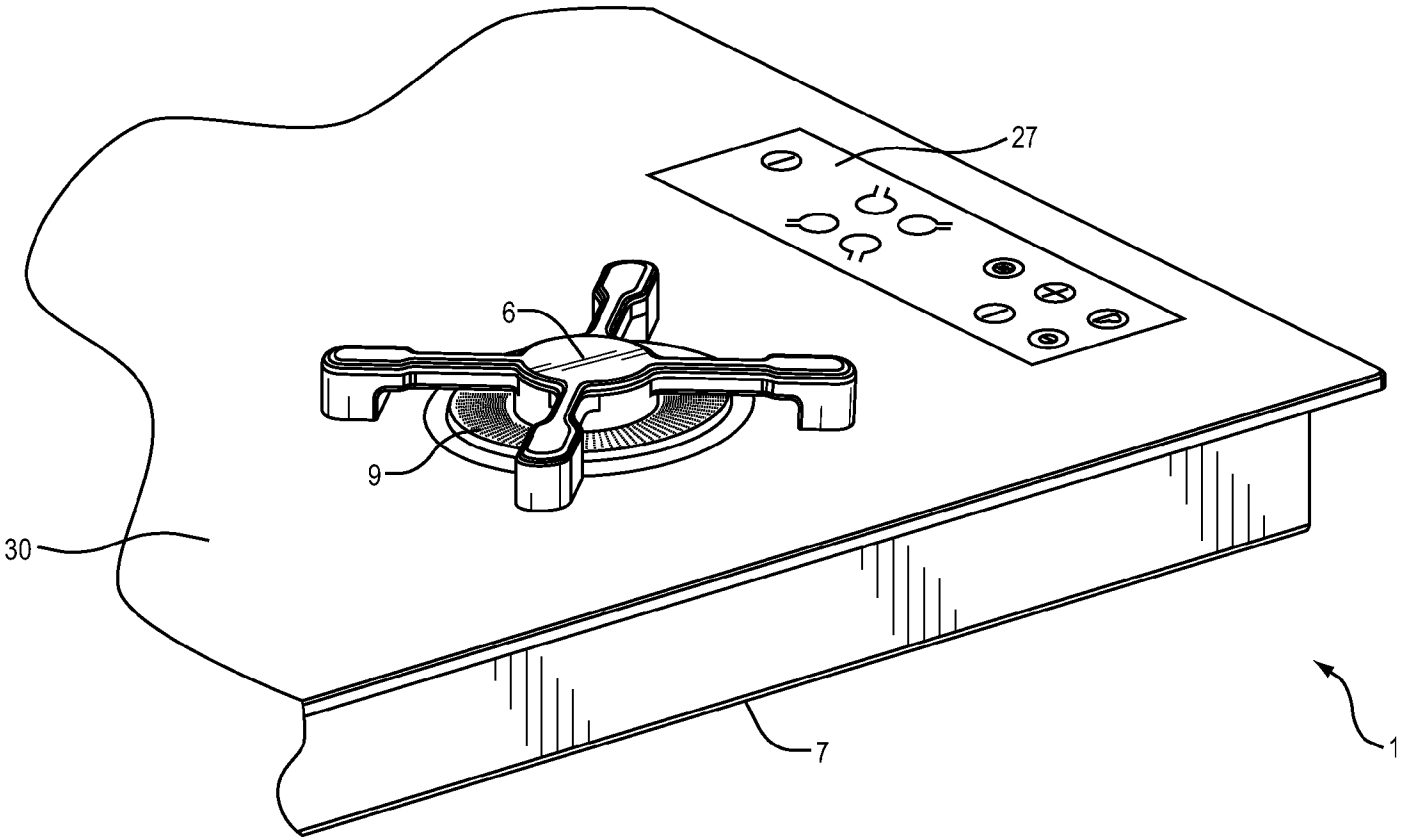

| | | | | | |
|---|---|---|---|---|---|
| 2,023,624 | A | * | 12/1935 | Tullis | 239/555 |
| 2,528,738 | A | * | 11/1950 | Calkins et al. | 431/328 |
| 2,625,991 | A | * | 1/1953 | Gappa et al. | 137/263 |
| 3,027,936 | A | * | 4/1962 | Lamp, Jr. | 431/283 |
| 3,169,871 | A | * | 2/1965 | Macchi et al. | 426/523 |
| 3,199,572 | A | * | 8/1965 | Auguste | 431/329 |
| 3,289,731 | A | * | 12/1966 | Geber | 126/39 R |
| 3,378,422 | A | * | 4/1968 | Kemp | 156/247 |
| 3,445,175 | A | * | 5/1969 | Krieger | 431/328 |
| 3,606,612 | A | * | 9/1971 | Reid, Jr. | 431/281 |
| 3,632,980 | A | * | 1/1972 | Hornaday et al. | 392/382 |
| 3,638,634 | A | * | 2/1972 | Bolitho | 126/41 R |
| 3,703,166 | A | * | 11/1972 | White et al. | 126/44 |
| 3,825,404 | A | * | 7/1974 | De Gouville | 431/354 |
| 3,858,811 | A | | 1/1975 | Mizerak et al. | |
| 3,892,518 | A | * | 7/1975 | Miyahara | 431/168 |
| 3,892,519 | A | * | 7/1975 | Reed et al. | 431/202 |
| 3,933,146 | A | * | 1/1976 | Hastings | 126/38 |
| 4,009,704 | A | * | 3/1977 | Marzetta | 126/221 |
| 4,083,355 | A | * | 4/1978 | Schwank | 126/39 J |
| 4,426,990 | A | * | 1/1984 | Shepherd | 126/9 B |
| 4,504,218 | A | * | 3/1985 | Mihara et al. | 431/326 |
| 4,541,407 | A | * | 9/1985 | Sommers et al. | 126/39 E |
| 4,569,328 | A | * | 2/1986 | Shukla et al. | 126/39 J |
| 4,622,946 | A | * | 11/1986 | Hurley et al. | 126/39 E |
| 4,673,349 | A | * | 6/1987 | Abe et al. | 431/328 |
| 4,763,639 | A | * | 8/1988 | Goldsworthy | 126/25 R |
| 4,767,915 | A | * | 8/1988 | Hurley | 219/456.1 |
| 4,781,170 | A | | 11/1988 | Perl | |
| 4,850,335 | A | * | 7/1989 | Farnsworth et al. | 126/299 R |
| 4,895,513 | A | * | 1/1990 | Subherwal | 431/328 |
| 4,919,609 | A | * | 4/1990 | Sarkisian et al. | 431/7 |
| 5,127,392 | A | * | 7/1992 | Mizuno et al. | 126/92 R |
| 5,137,583 | A | * | 8/1992 | Parent et al. | 136/253 |
| 5,205,731 | A | * | 4/1993 | Reuther et al. | 431/328 |
| 5,219,802 | A | * | 6/1993 | Hsiao et al. | 501/81 |
| 5,240,411 | A | * | 8/1993 | Abalos | 431/329 |
| 5,259,361 | A | * | 11/1993 | LeStrat et al. | 126/39 J |
| 5,378,956 | A | * | 1/1995 | Salzmann et al. | 313/141 |
| 5,427,525 | A | * | 6/1995 | Shukla et al. | 431/350 |
| 5,441,402 | A | * | 8/1995 | Reuther et al. | 431/7 |
| 5,543,180 | A | * | 8/1996 | Salzmann et al. | 427/397.7 |
| 5,645,411 | A | * | 7/1997 | Schaupert et al. | 431/77 |
| 5,649,822 | A | * | 7/1997 | Gertler et al. | 431/354 |
| 5,704,777 | A | * | 1/1998 | Measom | 431/329 |
| 5,731,065 | A | * | 3/1998 | Stelzmuller et al. | 428/198 |
| 5,800,156 | A | * | 9/1998 | Kahlke et al. | 431/328 |
| 5,800,157 | A | * | 9/1998 | Hasse et al. | 431/328 |
| 6,092,518 | A | * | 7/2000 | Dane | 126/214 D |
| 6,092,520 | A | * | 7/2000 | Hasegawa | 126/390.1 |
| 6,196,212 | B1 | * | 3/2001 | Taplan et al. | 126/39 R |
| 6,399,924 | B1 | * | 6/2002 | Cai | 219/443.1 |
| 6,508,245 | B2 | * | 1/2003 | Taplan | 126/39 R |
| 6,526,962 | B1 | * | 3/2003 | Taplan et al. | 126/39 R |
| 6,629,837 | B2 | * | 10/2003 | Carbone et al. | 431/354 |
| 6,889,685 | B2 | * | 5/2005 | Dane | 126/39 B |
| 6,945,196 | B1 | * | 9/2005 | Hubert et al. | 122/14.31 |
| D525,483 | S | * | 7/2006 | Schutts | D7/407 |
| 7,201,572 | B2 | * | 4/2007 | Wood et al. | 431/326 |
| 7,322,566 | B2 | * | 1/2008 | Anthony | 261/128 |
| 7,631,640 | B2 | * | 12/2009 | Hofbauer et al. | 126/39 R |
| 7,985,475 | B2 | * | 7/2011 | Dubrow | 428/359 |
| 2002/0164553 | A1 | * | 11/2002 | Distaso et al. | 431/280 |
| 2003/0024525 | A1 | * | 2/2003 | Jennings | 126/39 R |
| 2003/0075164 | A1 | * | 4/2003 | Dane | 126/39 R |
| 2004/0132607 | A1 | * | 7/2004 | Wood et al. | 501/95.1 |
| 2004/0157018 | A1 | * | 8/2004 | Lyublinski et al. | 428/35.7 |
| 2005/0250065 | A1 | * | 11/2005 | Carbone et al. | 431/354 |
| 2005/0277079 | A1 | | 12/2005 | Wu | |
| 2006/0000467 | A1 | * | 1/2006 | Hibshman et al. | 126/39 E |
| 2006/0024632 | A1 | * | 2/2006 | Sanchez | 431/354 |
| 2007/0269758 | A1 | * | 11/2007 | Hofbauer et al. | 431/328 |

FOREIGN PATENT DOCUMENTS

| | | | | | |
|---|---|---|---|---|---|
| CN | 1066115 | | | 11/1992 | |
| DE | 392522 | | | 3/1924 | |
| DE | 3529005 | A1 | | 2/1987 | |
| DE | 3918722 | | | 11/1990 | |
| DE | 10315343 | A1 | | 10/2004 | |
| EP | 0485645 | | | 5/1992 | |
| EP | 0552135 | A | | 7/1993 | |
| EP | 651203 | A1 | * | 5/1995 | F23D 14/78 |
| EP | 1132685 | | | 9/2001 | |
| EP | 1531304 | A | | 5/2005 | |
| FR | 432193 | | | 11/1911 | |
| FR | 2404803 | | | 4/1979 | |
| FR | 2414681 | | | 8/1979 | |
| GB | 315011 | | | 8/1929 | |
| GB | 2223302 | | | 4/1990 | |
| GB | 2233444 | A | | 1/1991 | |
| GB | 2280743 | | | 2/1995 | |
| JP | 57070327 | A | * | 4/1982 | F24C 15/10 |
| JP | 61086507 | | | 5/1986 | |
| JP | 2005164135 | A | * | 6/2005 | F23D 14/06 |
| WO | WO 9318342 | A1 | * | 9/1993 | F23D 14/14 |
| WO | WO 94/14608 | | | 7/1994 | |
| WO | WO 95/27871 | | | 10/1995 | |
| WO | WO 02/099173 | A1 | | 12/2002 | |
| WO | WO 2005/078342 | | | 8/2005 | |
| WO | WO 2005100856 | | | 10/2005 | |
| WO | WO 2007/012766 | | | 2/2007 | |
| WO | WO 2008/104831 | | | 9/2008 | |

OTHER PUBLICATIONS

U.S. Appl. No. 12/571,489, filed Oct. 1, 2009 by Paolo Faraldi, entitled Protective Liner and System for Protecting a Cooking Top, 21 Pages.

* cited by examiner

COOKING TOP WITH GAS BURNER COMPRISING A SEMI-PERMEABLE ELEMENT

The present invention relates to a cooking top, in particular adapted to be used in a household environment, comprising at least one gas burner.

At present, several typologies of cooking tops adapted to be used in a household environment are available on the market, the most widespread typology using one or more gas burners, wherein the amount of heat necessary for cooking food is generated through combustion of a gas appropriately mixed with air. Many gas burners currently installed in cooking tops for domestic use comprise two external components: a flame divider and a cap. The flame divider is usually made of die-cast aluminium and is adapted to generate a flame having a crown configuration, whereas the cap, usually made of enamelled cast iron (or brass alloy, or steel), acts as a flame divider closing element, thus preventing the air-gas mixture from flowing axially out of the burner. The assembly consisting of flame divider and cap originates a so-called "cup" burner using, as primary air to be mixed with gas, the air being present above the cooking top, which enters the burner through access areas delimited by so-called "skirts", i.e. profiles suitably applied to the underside of the flame divider.

By "crown flame" it is meant a flame having a substantially radial propagation direction. If emitted at an insufficient height above the cooking top, it may cause a low-$O_2$ combustion resulting in the generation of a high level of unburnt products (CO and $NO_x$) and, due to the thermal content of the flame, it may lead to deformation and/or blackening of the portion of the cooking top surrounding the burner. In order to obtain an adequate primary air flow toward the gas mixing area and to have such an amount of secondary air available as to obtain a low-CO and low-$NO_x$ combustion, the cup burner must reach a certain height above the cooking top wherein it is installed, and the pot supports must remain at a suitable height (between 15 and 20 mm) relative to the burner. In particular, the height of the cup burner is approximately 30 mm above the cooking top, so that it is necessary that the pot supports used on the cooking top reach a height of approximately 45÷50 mm above the cooking top.

Though the above-mentioned gas burners offer a number of advantages which promoted their large-scale diffusion, such as adaptability to different types of fuel gas and competitive industrial costs, they remain however very difficult to clean. As a matter of fact, many gas burners for domestic use currently available on the market require the removal of external components to be cleaned properly. Once cleaned separately, said external components must then be repositioned correctly in order to reassemble the gas burner. It follows that cleaning cooking tops available on the market today requires much time and generally gives bad results, also because of the very complex geometry of said external components, which hinders dirt removal.

The general object of the present invention is to provide an improved cooking top compared to the prior art.

It is a specific object of the present invention to overcome the above drawback through a cooking top with at least one innovative gas burner adapted to be preferably installed in a household environment.

The cooking top adapted to substantially attain said objects incorporates the features set out in the annexed claims, which form an integral part of the present description.

The present invention is based on the idea of providing a cooking top which, to be cleaned, does not require the removal of any external components or, as an alternative, only requires a minimal removal of external components, so as to offer the users of the cooking top according to the present invention a substantial time saving and a considerable increase in the effectiveness of the cleaning treatment.

According to the present invention, said idea is implemented through a gas burner comprising a semi-permeable element (typically micro-perforated sheet or fibrous membrane or porous membrane) capable of withstanding high temperatures such as those generated by the combustion of a fuel gas and air; said semi-permeable element is permeable to fuel gas and to any mixture comprising fuel gas and air, and is substantially impermeable to liquids.

By "semi-permeable" element it is meant, in the present description and in the annexed claims, an element which can be run through by flows of gaseous substances, such as an air-gas mixture, at the same time being capable of rejecting, totally or almost totally, any flow of liquid substances. In the event that liquid flows should manage to run through it, the semi-permeable element is advantageously capable of ensuring that said liquid flows do not compromise the correct functionality of the gas burner, i.e. it is capable of ensuring that the gas burner can be lighted again should said liquid flows extinguish the flame.

By "substantially impermeable to liquids" it is meant, in the present description and in the annexed claims, an element which is capable of preventing, totally or almost totally, any liquids to flow through. In the event that liquid flows should manage to run through it, said element is advantageously capable of ensuring that said liquid flows do not compromise the correct functionality of the gas burner, i.e. it is capable of ensuring that the gas burner can be lighted again should said liquid flows extinguish the flame.

The semi-permeable element may typically be a micro-perforated sheet, or a fibrous membrane, in particular made of metal, metal alloy, ceramic or carbon fibers, or a porous membrane, in particular made of a ceramic material, a composite material or a metal material.

Figure 2A:
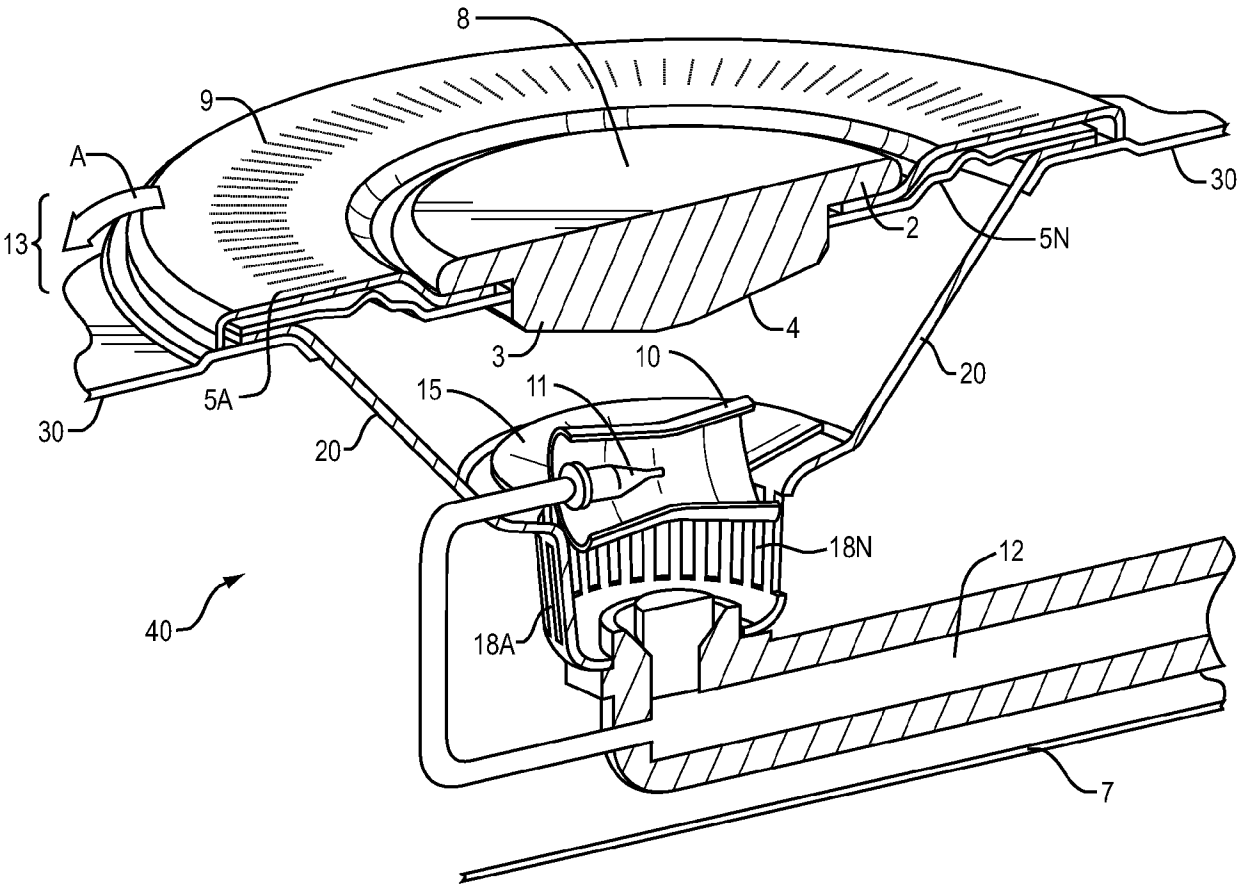
Figure 2B:
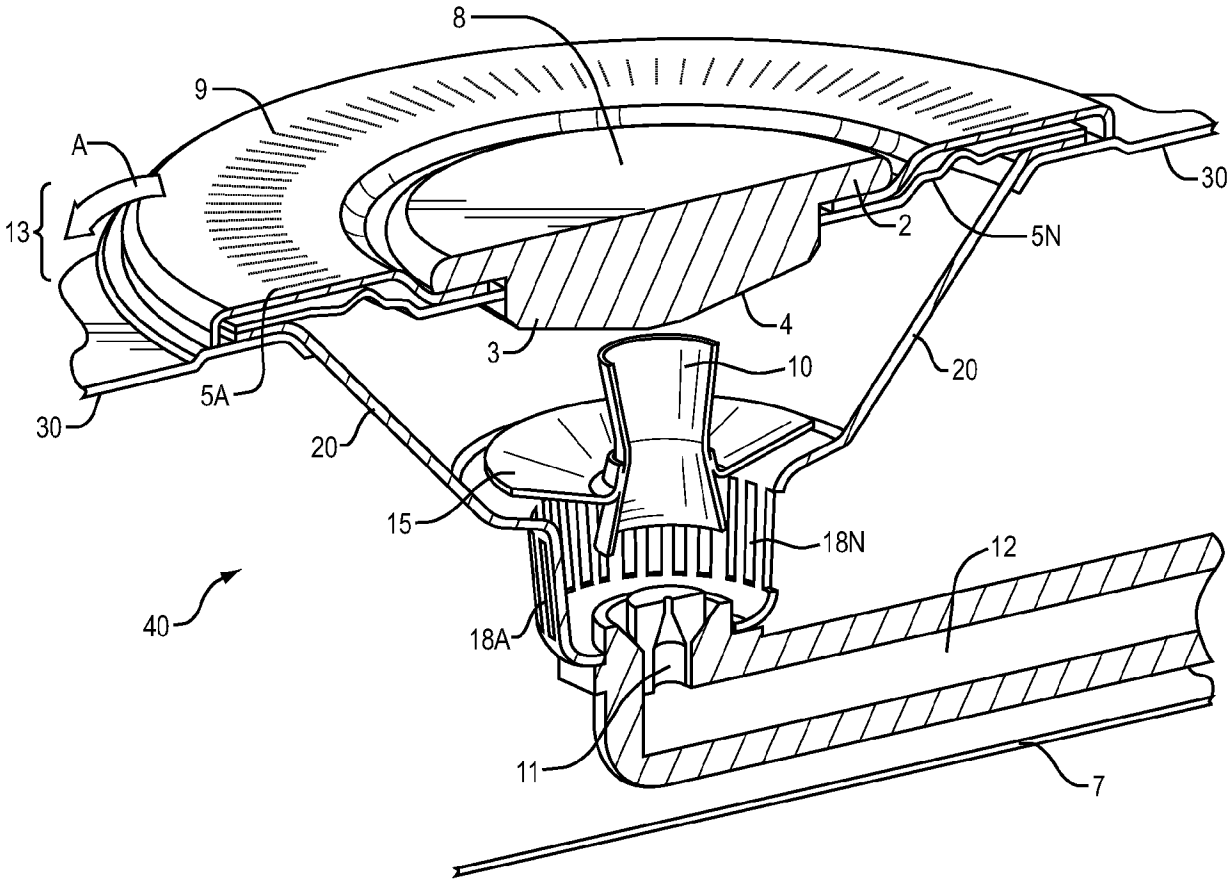

The present invention will become apparent, together with its further advantages, from the following detailed description and from the annexed drawings, which are supplied by way of non-limiting example, wherein:

FIG. 1 schematically shows a detail of a cooking top which represents a possible embodiment of the present invention;

FIGS. 2A and 2B are schematic sectional views of a cooking top which represents a possible embodiment of the present invention;

and

FIGS. 3*a*-3*d* schematically shows a possible embodiment of a component of a cooking top 1 according to the present invention, in particular of the component called "flame divider means".

FIG. 1 illustrates a cooking top 1 according to the present invention, in particular a flush-mountable cooking top 1. The cooking top is so shaped as to comprise a box 7 closed on top by a covering element, specifically a substantially flat visible surface 30, on which a plurality of housing means is obtained, at least one of said housing means being preferably a hole adapted to accommodate a burner, in particular a gas burner 40 as shown in the sectional views of FIGS. 2A and 2B. The cooking top may also comprise pot supporting means 6, adapted to ensure an appropriate separation distance between the visible surface 30 of the cooking top 1 and a pot containing food to be cooked, as well as interface means 27 adapted to, among other things, allow to adjust and/or display the operating parameters of each burner. The interface means 27 shown in FIG. 1 consist of a "touch control" interface, but they may also consist of a mechanical interface with on-off taps. The gas burner 40 illustrated in FIGS. 2A and 2B, adapted to be installed in a cooking top 1 according to the present invention, comprises first means adapted to supply fuel gas to the gas burner and preferably comprising an injector 11, second means adapted to draw air inside the gas burner and preferably comprising a Venturi element 10, and third means adapted to mix fuel gas with air and/or to provide the combustion of fuel gas and/or any mixture comprising fuel gas and air, and preferably comprising a burner cup 20.

More in detail:

the first means operate as gas injection means and comprise in particular the injector 11 (which may be either vertical, i.e. with its axis parallel to the axis of the burner cup 20, or horizontal, i.e. with its axis orthogonal to the axis of the burner cup 20), adapted to spread the gas inside the gas burner 40, and the injector holder 12, adapted to connect the injector 11 to the gas supply main;

the second means operate as means for drawing primary air inside the gas burner 40 and as air-gas mixing means, and comprise in particular the intakes 18A-18N, adapted to allow primary air to flow inside the gas burner 40, and the Venturi element 10 (which may be either vertical, i.e. with its axis parallel to the axis of the burner cup 20, or horizontal, i.e. with its axis orthogonal to the axis of the burner cup 20, and which in FIGS. 2A and 2B is connected to the burner cup 20 to the plate 15 through the plate 15), adapted to create, inside the gas burner 40, a vacuum adapted to convey gas and primary air toward the mixing and/or combustion area and the third means operate as structural means and advantageously have a substantially axially symmetric shape, with an axis essentially orthogonal to the visible surface 30 of the cooking top 1, and comprise in particular the burner cup 20, which is adapted to ensure a stable support for the other burner components on top of it and to delimit the area where the mixing of gas and primary air and/or the combustion of the air-gas mixture takes place.

It is now worth specifying the meaning of the terms "primary air" and "secondary air" as used in the present description. "Primary air" is air mixed with fuel gas inside the gas burner 40, whereas "secondary air" is air added to the already formed air-gas mixture in the area outside the cooking top 1 surrounding the gas burner 40, which air provides the additional $O_2$ required for a proper combustion. According to an advantageous embodiment of the cooking top 1 according to the present invention, the intakes 18A-18N for primary air access are obtained directly on the burner cup 20, specifically on the portion thereof being adjacent to the injector 11 and upstream of the Venturi element 10. In order to ensure a stoichiometrically correct mixture of gas and primary air in accordance with the combustion process the mixture will be subjected to, the intakes 18A-18N obtained on the burner cup 20 are large enough to provide an adequate primary air flow through them. In the event that natural circulation does not guarantee a sufficient primary air flow rate to properly supply air to the gas burner 40, a primary air forced circulation system may be associated with the gas burner 40.

The terms "crown flame" and "carpet flame" will also be used in the present description. A "crown flame" is a flame which propagates out of the gas burner 40 in a substantially radial direction relative to the axis of the gas burner 40, i.e. in a substantially tangential direction relative to the visible surface 30 of the cooking top 1. Some examples of crown flames are all those flames generated by gas burners comprising, as external components, a flame divider and a cap such as those known in the art. A "carpet flame", on the other hand, is a flame which propagates out of the gas burner 40 in a substantially axial direction relative to the axis of the gas burner 40, i.e. in a substantially orthogonal direction relative to the visible surface 30 of the cooking top 1. A carpet flame may be either a "total" carpet flame or a "perimetric" carpet flame, depending on whether it covers a geometric figure (generally a circle) entirely or it covers just the peripheral portion of said geometric figure (generally a circular crown).

The flame divider means 9 may be connected to the visible surface 30 and/or to the burner 40; furthermore, they comprise at least one semi-permeable element 90, being permeable to fuel gas and to any mixture comprising fuel gas and air and being substantially impermeable to liquids, which may be a micro-perforated sheet, or a fibrous membrane made of metal, metal alloy, ceramic or carbon fibers, or a porous membrane made of a ceramic, composite or metal material. The semi-permeable element 90 is located on top of the third means of the gas burner 40, in particular on top of the burner cup 20. Advantageously, the flame divider means 9 and/or the semi-permeable element 90 have a substantially axially symmetric shape, the axis of the flame divider means 9 and/or of the semi-permeable element 90 preferably essentially coinciding with the axis of the third means of the gas burner 40. The flame divider means 9 also provide the functions of delimiting the internal environment of the gas burner 40 at the top and of allowing the flame generated by the combustion of the air-gas mixture to exit the gas burner 40 through the semi-permeable element 90.

The semi-permeable element 90 may be required to have a number of specific properties, including:

permeability to a gas and to air-gas mixtures, said gas being preferably a natural fuel gas such as $CH_4$, or a liquefied fuel gas like LPG, or an artificial fuel gas like the so-called "town gas", obtained through gasification of liquid or solid fuels, or any other fuel among those used in the different countries;

total or essentially total impermeability to liquid substances, which cannot prevent the ignition of the gas burner 40 even when overflowing from a container having a certain height (which can be assumed to be 250 mm);

appropriate porosity to ensure the above-described semi-permeability and at the same time to cause low load losses to the flows of gas or air-gas mixtures going through the semi-permeable element 90, so that they can flow out of the gas burner 40 at an adequate velocity to ensure flame stability during the combustion (e.g. for air-$CH_4$ mixtures, said velocity is preferably comprised between 1.5 m/s and 3 m/s);

high thermal resistance, which prevents the semi-permeable element 90 from suffering evident deformation when run through by the flame;

sufficient mechanical strength to prevent the semi-permeable element 90 from suffering evident deformation should it undergo an accidental impact, e.g. against a cooking container, or should it fall down during maintenance operations, and to prevent it from suffering evident abrasion during cleaning operations;

sufficient thermomechanical strength to ensure that any deformation suffered by the semi-permeable element 90 should it come in contact with an overflowing liquid having a different temperature is minimal and/or adequate surface finish to properly integrate said semi-permeable element 90 in or with the flame divider means 9 and with the cooking top I whereon the burner is installed, without evident blackening of said semi-permeable element 90 during the operation of the gas burner 40.

Figure 3B:
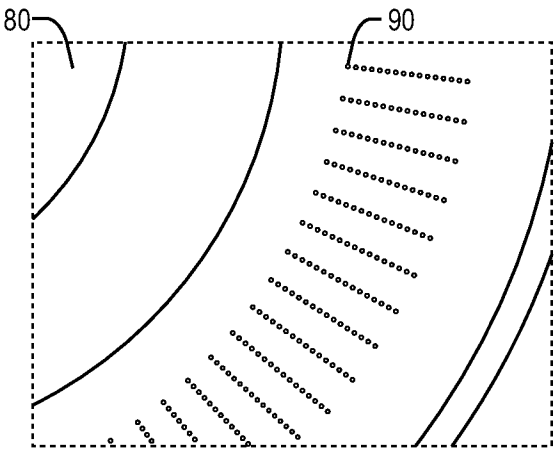
Figure 3A:
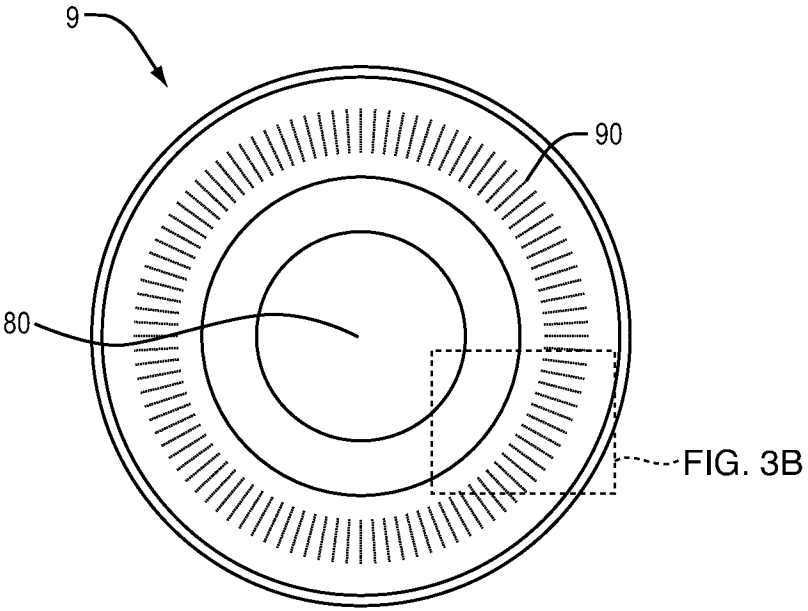

According to a first possible embodiment of the present invention, the flame divider means 9 comprise a sheet, in particular a metal or metal alloy sheet, which is characterized by being micro-perforated, i.e. by comprising a series of holes whose diameter is preferably equal to or smaller than the sheet thickness. The holes and the surrounding sheet form as a whole the semi-permeable element 90. FIGS. 3A and 3B show, for the purpose of explaining said first embodiment of the present invention, an example of a micro-perforated sheet comprised in flame divider means 9 (which can be used with the gas burner 40 shown in FIGS. 2A and 2B) and adapted to be used as a semi-permeable element 90. Furthermore, the enlargement annexed to FIG. 3A shows a detail of said micro-perforated sheet to illustrate a possible distribution of the holes in the semi-permeable element 90. The thickness of the micro-perforated sheet is preferably about 1 mm, so as to obtain a valid compromise between the mechanical strength of the micro-perforated sheet and the load losses undergone by the air-gas mixture flowing through the micro-perforated sheet. If the thickness is approximately 1 mm, the diameter of the holes of the micro-perforated sheet will be advantageously comprised between 100 μm and 1 mm.

According to a second possible embodiment of the present invention, the flame divider means 9 comprise, as a semi-permeable element 90, a fibrous membrane made of e.g. metal, metal alloy, ceramic or carbon fibers, or a porous membrane made of e.g. a ceramic, composite or metal material, both of said membranes being able to ensure semi-permeability as well as an adequate gaseous flow and adequate thermal, mechanical and thermomechanical resistance. In particular, the most suitable membranes to be used in the cooking top 1 according to the present invention are membranes made out of woven, unwoven or partially woven metal fibers specifically designed for use near heat sources.

Many examples of the above metal fiber membranes can be found in the patent literature: by way of example and not by way of limitation, it can be stated that the most suitable membranes to be used in the cooking top I according to the present invention are those described in patent applications WO94/14608, WO95/27871 and WO02/99173.

In the present description a cooking top 1 according to the present invention will be illustrated in detail, which comprises at least one gas burner 40 and flame divider means 9 comprising a micro-perforated sheet used as a semi-permeable element 90. It is however clear that the following detailed description should be understood as an example which does not restrict the much broader inherent inventive concepts of the present invention. Likewise, it is clear that the advantages of the present invention remain unchanged if the micro-perforated sheet is replaced with a semi-permeable membrane made of metal or metal alloy fibers or of a ceramic or composite material.

The micro-perforated sheet may be substantially discoidal in shape and essentially orthogonal to the axis of the gas burner 40. Moreover, the holes obtained in the sheet may be through holes with axes essentially parallel to the axis of the gas burner 40: following the combustion of the air-gas mixture, this setup originates a carpet flame, i.e. a flame exiting the gas burner 40 in a substantially orthogonal direction relative to the visible surface 30 of the cooking top 1. According to this embodiment, the cooking top 1 according to the present invention differs from any prior-art household cooking top also because it produces a carpet flame instead of a crown flame. A carpet flame generally provides a higher yield than a crown flame, and also overcomes the latter's typical drawback of causing low-$O_2$ flames and/or blackening in the cooking top area surrounding the gas burner 40, if the flame is emitted at an insufficient height above the visible surface 30 of the cooking top 1.

In the cooking top 1 according to the present invention, the flame divider means 9 and/or the semi-permeable element 90 are located essentially at the same level above the visible surface 30 of the cooking top 1. Furthermore, the pot supporting means 6 may reach a height being equal to or lower than 30 mm above the visible surface 30 of the cooking top 1, preferably a height comprised between 15 mm and 20 mm above the visible surface 30 of the cooking top 1, which is significantly lower than the height of about 45÷50 mm above the cooking top reached by pot supports used in prior-art cooking tops for domestic use with at least one gas burner. Thanks to this configuration of the flame divider means 9 comprising the previously described micro-perforated sheet, it is also possible to obtain a considerable lowering of the gas burner 40, which is also perfectly in agreement with the current design trends aiming at obtaining simple geometries with lines being as essential and harmonious as possible. The generation of a similar carpet flame and a resulting similar lowering of the burner may also be obtained by using, instead of a micro-perforated sheet, a semi-permeable membrane made of metal or metal alloy fibers or made of a ceramic or composite material.

The flame divider means 9 comprising the micro-perforated sheet in particular, and the semi-permeable element 90 in general, may be secured in different alternative ways:

first the gas burner 40 is secured to the cooking top 1, and then the flame divider means 9 are applied together with the micro-perforated sheet by removably or irremovably securing said means to the cooking top 1;

first the flame divider means 9 are removably or irremovably secured to the third means of the gas burner 40, and then the burner is secured to the cooking top or the flame divider means 9 are obtained in one piece with another burner component, e.g. with the burner cup 20 appropriately shaped to comprise also an upper surface adapted to be used as a semi-permeable element 90 (e.g. adapted to be subjected to a micro-perforation treatment).

If a semi-permeable membrane is used, made of metal or metal alloy fibers or of a ceramic or composite material, the requirement of securing the membrane to the cooking top 1 may go side by side with the need of giving adequate strength to the membrane. In such a case, it is possible to shape the burner cup 20 to comprise supporting means in its top area, on which the membrane is laid before being secured. By way of example, said supporting means may consist of profiles extending on the inner surface of the burner cup 20 in a substantially radial direction, or of a grate connected to the burner cup 20 and lying in a plane essentially orthogonal to the axis of the gas burner 40.

According to an embodiment of the present invention, the semi-permeable element 90 has a substantially annular shape, which is considered to be particularly advantageous for at least one of the two following reasons:

secondary air is drawn with more difficulty in the central area than in the peripheral area, so that in the central area of the semi-permeable element 90 the combustion of the air-gas mixture may be imperfect, thus generating unburnt products (whose presence is indicated by so-called "yellow tips" on flame ends)

and generating a flame in the peripheral area of the semi-permeable element 90 means producing an extended flame which provides adequate heat distribution in the area above the gas burner 40 during the food cooking process.

Figure 3C:
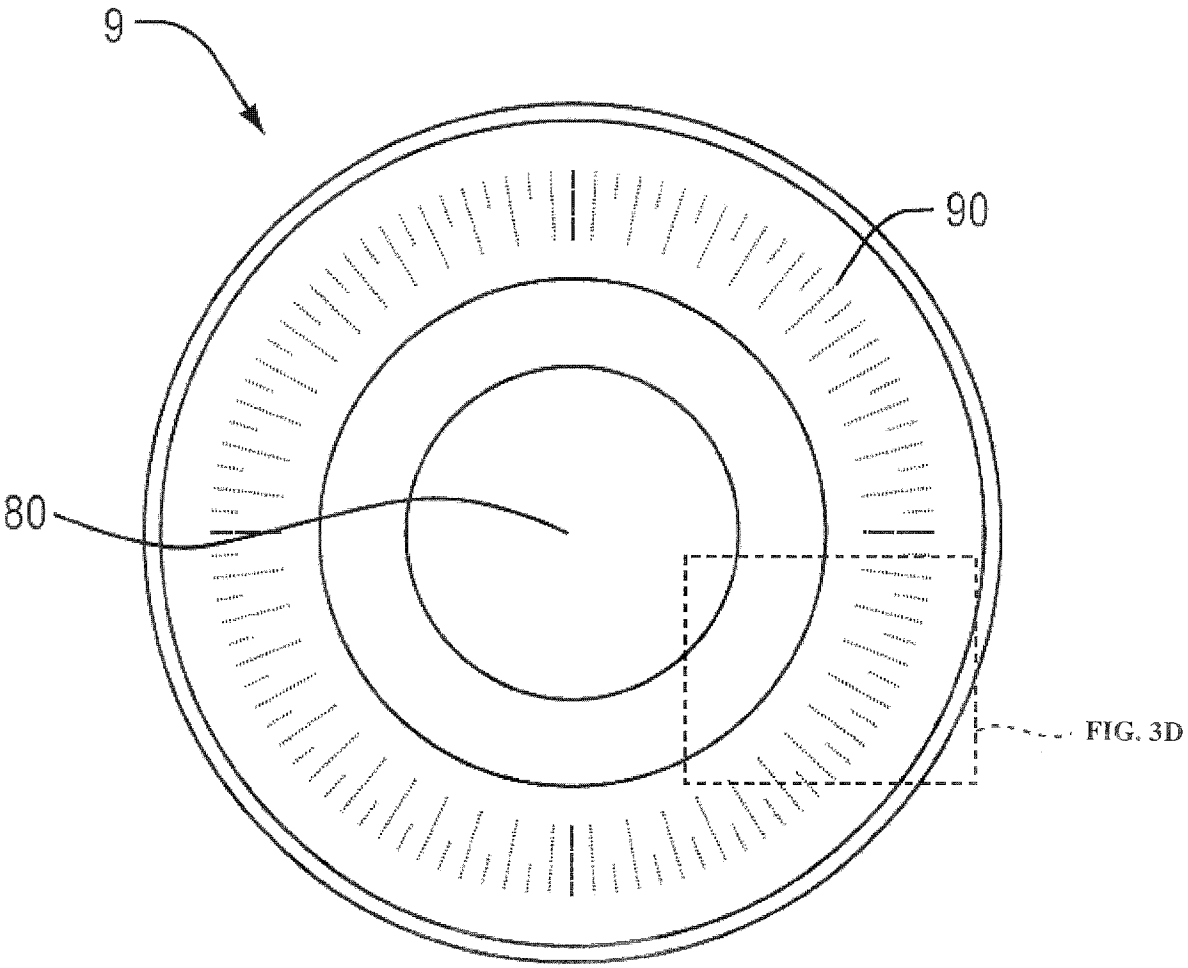
Figure 3D:
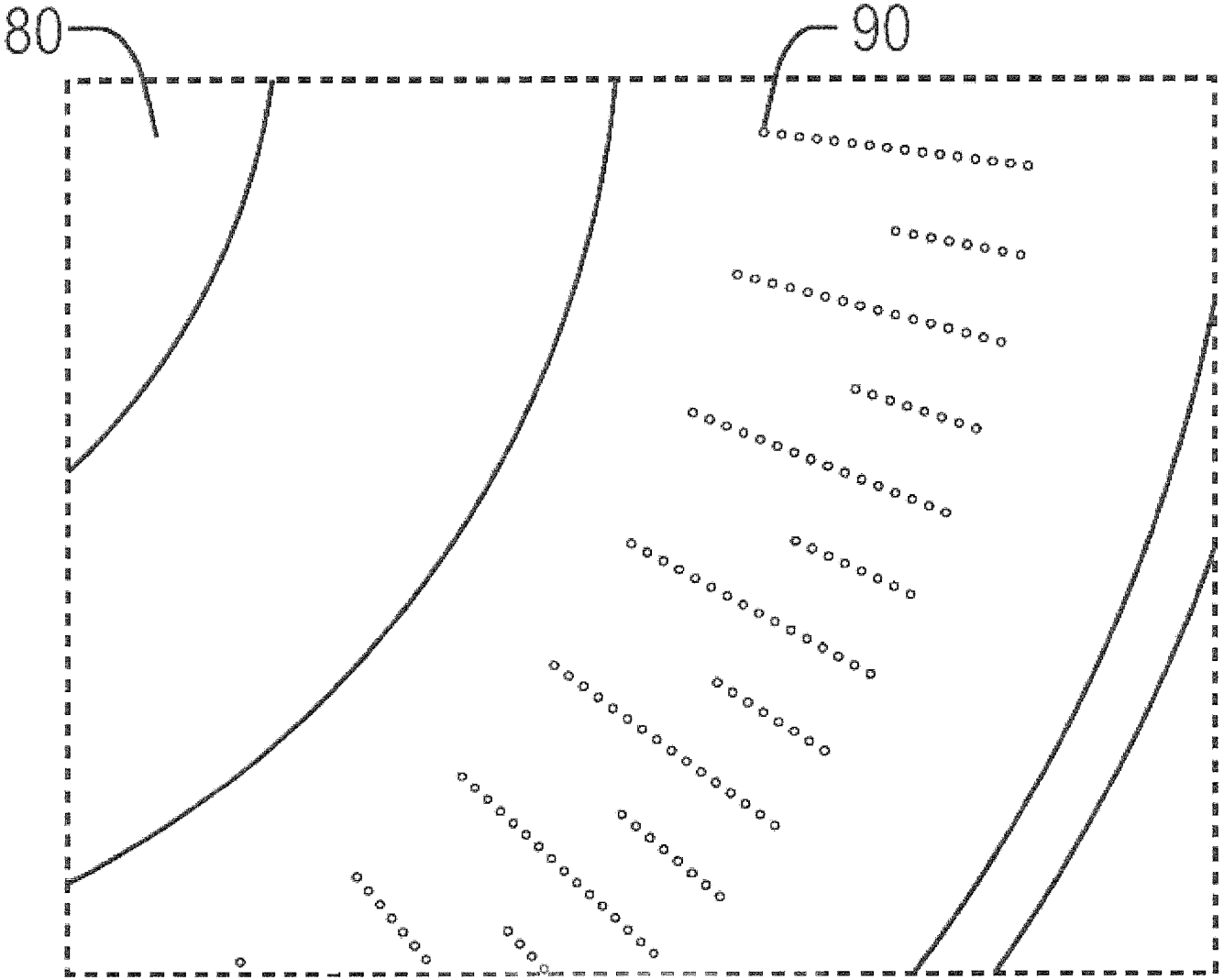

If the semi-permeable element 90 consists of a micro-perforated sheet, it is possible to provide a distribution of the holes on the micro-perforated sheet according to which the holes are more densely distributed in the peripheral area than in the central area as shown in FIGS. 3*c* and 3*d*.

According to the embodiment of the invention illustrated in FIGS. 2A and 2B, the cooking top 1 also comprises at least one securing device 8, adapted to connect the flame divider means 9 to the cooking top 1 and/or to the gas burner 40. The flame divider means 9 comprise housing means adapted to house the securing device 8. The flame divider means 9 are so shaped as to have a hole 80 in their central area, preferably a circular hole whose axis essentially coincides with the axis of the gas burner 40. It is conceivable to exploit said central area of the flame divider means 9 to secure the flame divider means 9 to the cooking top 1 and/or to the gas burner 40 and to provide easy access to the internal components of the gas burner 40 for maintenance purposes. Said central hole 80 acts as a housing for the securing device 8 which, passing through it, is then secured by means of a removable connection, such as a screw-nut connection, to suitable supporting means 5A-5N comprised in the third means of the gas burner 40 (preferably made integral with the burner cup 20, e.g. through spot welding). The securing device 8 is a removable device and is therefore adapted to grant access to the inside of the gas burner 40 for maintaining the gas burner 40 and for allowing the flame divider means 9 and/or the semi-permeable element 90 to be removed easily.

Preferably, the securing device 8 comprises two parts: a first part 2 being substantially discoidal in shape and a second part 3 being substantially tubular in shape. The first part 2 has a larger diameter than the diameter of the central hole 80 of the flame divider means 9, whereas the second part 3 has a smaller diameter than the diameter of the central hole 80 and is fitted, on its side surface or at least a portion thereof, with anchoring means adapted to ensure a firm connection between the securing device 8 and the supporting means 5A-5N comprised in the third means of the gas burner 40. The flame divider means 9 are thus secured to the gas burner 40 because a portion of said flame divider means 9, in particular the portion surrounding the central hole 80, is interposed between the first part 2 of the securing device 8 and the supporting means 5A-5N in such a way as to prevent the air-gas mixture from flowing out between the flame divider means 9 and the securing device 8 as well as between the flame divider means 9 and the visible surface 30 of the cooking top 1. Since the connection between the securing device 8 and the supporting means 5A-5N is a removable connection, embodiment of the present invention illustrated in FIGS. 2A and 2B ensures access inside the gas burner 40 for maintenance operations such as the replacement of the injector 11. Furthermore, the embodiment of the present invention illustrated in FIGS. 2A and 2B allows to remove the flame divider means 9 and/or the semi-permeable element 90 easily from the respective installation places, e.g. in order to wash them in a dishwasher, replace the flame divider means 9 and/or replace the semi-permeable element 90, in the event that these parts have suffered damage and are no longer operating properly.

It may be particularly useful to provide the securing device 8 with flow diverter means 4, adapted to help the air-gas mixture exiting the Venturi element 10 to reach the semi-permeable element 90: for this purpose, the second part 3 of the securing device 8 may be flared or have a decreasing section, reaching its minimum diameter on its free end. Since the semi-permeable element 90, according to the present invention, may also be run through by a small quantity of liquids (which however must be such as not to prevent a subsequent ignition of the gas burner 40 should the flame be extinguished), the flame divider means 9, comprising the semi-permeable element 90, may be advantageously associated with means adapted to divert said liquids toward areas wherein they cannot hinder the operation of the gas burner 40.

As diverter means 13, one may use die-cast or forged profiles made of sheet-metal, brass, cast iron or steel, comprising holes adapted to allow gaseous substances to flow through (to supply the combustion of the gas burner 40) and having a diameter adapted to prevent said flow from suffering high load losses (e.g. the diameter of the holes of the diverter means may be about 500 ÷600 μm).

It is apparent from the present description that the cooking top, in particular the cooking top 1 comprising at least one gas burner 40, according to the present invention overcomes the inherent drawbacks of most cooking tops comprising at least one gas burner currently available on the market, since it is much easier to clean. It is also apparent that the generation of a carpet flame by the gas burner and the semi-permeable element 90 (micro-perforated sheet, metal or metal alloy fibrous membrane, or ceramic or composite membrane) as described offers the users of the cooking top 1 according to the present invention all the advantages which distinguish a carpet flame from a crown flame, as enunciated in the present description. However, said generation of a carpet flame must not be considered to be a fundamental element of the present invention, since the inherent inventive concepts of the present invention may also be used to generate a crown flame instead of a carpet flame. For this purpose, the flame divider means 9 and/or the semi-permeable element 90 (micro-perforated sheet, metal or metal alloy fiber membrane, or ceramic or composite membrane) may have a substantially hollow cylindrical shape instead of a substantially discoidal shape and may be positioned on top of the gas burner 40 so as to allow the combustion air-gas mixture to flow out of the gas burner 40 in a substantially radial direction. In this case, the flame divider means do not delimit the gas burner 40 on top and may therefore be associated with covering means adapted to prevent the air-gas mixture from flowing out of the gas burner 40 axially and possibly also to make it easier for the air-gas mixture to reach the semi-permeable element 90. The inherent inventive concepts of the above description may also be used to generate an inclined flame, i.e. a flame which, when exiting the flame divider means 9 and/or the semi-permeable element 90, has a propagation direction not being parallel to either the visible surface 30 of the cooking top 1 (like a crown flame) or the axis of the gas burner 40 (like a carpet flame).

A much innovative aspect of the present invention concerns the use of extended combustion areas inside of cooking tops, in particular for domestic use; said areas may, for example, be shaped as a circle, an ellipse, a polygon, a circular crown (as in the example of FIGS. 2A and 2B), an elliptic crown, or a polygonal crown. Such a cooking top comprises at least one gas burner and respective flame divider means having a (burning) gas outlet area, as in the examples of FIGS. 2A and 2B, and comprising a micro-perforated sheet, a fibrous membrane, or a porous membrane.

Said area may extend in a substantially horizontal direction (the horizontal direction being the direction in which the cooking top is adapted to be arranged), as in the example of FIG. 2A; if the extension of said area were not horizontal, but inclined by an angle of e.g. 30° or 45° or 60° , the flame divider means would visibly protrude from the covering element of the cooking top (the visible surface 30 in the illustrated example).

The flame divider means may be so provided as to produce a gaseous flow in a substantially vertical direction (the horizontal direction being the direction in which the cooking top is adapted to be arranged), i.e. directly toward the flat bottom of a cooking container.

A cooking top using the "combustion area" concept may be fitted with one or several gas burners.

In the former case, the cooking top comprises just one burner and respective flame divider means, and the combustion area may substantially take up the entire cooking area of the cooking top.

In the latter case, the cooking top comprises a plurality of cooking points, preferably two to six cooking points, and a corresponding plurality of burners and flame divider means having a corresponding plurality of spaced gas outlet areas.

The present invention has been described with reference to a particular embodiment example, but it is clear that many changes may be made thereto by those skilled in the art without departing from the scope defined by the annexed claims.

The invention claimed is:

1. A cooking top comprising:

at least one burner for use with at least one fuel gas;

each gas burner having:

first means including an injector adapted to supply said fuel gas or a mixture thereof with air;

second means including a Venturi element adapted to draw the air;

third means adapted to mix and/or provide combustion of the fuel gas and the air supplied by said first and second means; and flame divider means secured to said gas burner, said flame divider means including at least one semi-permeable element having a substantially annular shape, said semi-permeable element being a micro-perforated sheet that is permeable to gaseous substances, in particular to said fuel gas and to any mixture including said fuel gas and the air, and being substantially impermeable to liquid substances, wherein holes on the semi-permeable element are more densely distributed in a peripheral area than in a central area, and wherein the flame divider means allows a flame generated by the combustion of the fuel gas and the air to exit through the semi-permeable element.

2. The cooking top according to claim 1, further comprising:

a covering element; and said third means is a burner cup having a substantially axially symmetric shape, the axis being preferably essentially orthogonal to the covering element.

3. The cooking top according to claim 2, wherein said flame divider means are connected to one or both of said at least one burner and the covering element.

4. The cooking top according to claim 2, wherein one or both of said flame divider means and said semi-permeable element have a substantially hollow cylindrical shape with an axis preferably coinciding with the axis of said third means; and said gas burner and said semi-permeable element can generate a crown flame, said crown flame being a flame which propagates in a substantially tangential direction relative to the circumference of the flame divider.

5. The cooking top according to claim 1, wherein said semi-permeable element is positioned on top of said third means.

6. The cooking top accordingly to claim 5, wherein one or both of said flame divider means and said semi-permeable element have a substantially axially symmetric shape with an axis that essentially coincides with the axis of said third means.

7. The cooking top according to claim 1, further comprising a covering element; and one or both of said flame divider means and said semi-permeable element are located essentially at the same level relative to the covering element.

8. The cooking top according to claim 7 further comprising pot supporting means, said pot supporting means reaching a height being equal to or lower than 30 mm above said covering element.

9. The cooking top according to claim 8, wherein said pot supporting means reaches a height between 15 mm and 20 mm above said covering element.

10. The cooking top according to claim 1, wherein said gas burner and said semi-permeable element can generate a carpet flame, said carpet flame being a flame which propagates in a substantially orthogonal direction relative to a covering element.

11. The cooking top according to claim 1, wherein said Venturi element is horizontal.

12. The cooking top according to claim 1 further comprising said semi-permeable element and said flame divider means being located at the same level above a visible surface of the cooking top.

13. The cooking top according to claim 1 wherein the flame divider means further includes a central portion that is not micro-perforated.

14. The cooking top according to claim 13 wherein the central portion is a hole.

15. A cooking top comprising:

at least one gas burner which can be used with at least one fuel gas, each gas burner having:

(i) first means adapted to supply the fuel gas or a mixture thereof with air;

(ii) second means adapted to draw the air; and (iii) third means adapted to supply the fuel gas or a mixture thereof with the air;

flame divider means associated with said gas burner, said flame divider means having at least one semi-permeable element having a substantially annular shape, said semi-permeable element being a micro-perforated sheet that is permeable to gaseous substances, in particular to said fuel gas and to any mixture including said fuel gas and the air, and being substantially impermeable to liquid substances;

wherein holes on the semi-permeable element are more densely distributed in a peripheral area than in a central area;

wherein said flame divider means allows a flame generated by a combustion of the fuel gas and the air to exit through the semi-permeable element;

wherein said flame divider means is secured to one or both of said gas burner and a covering element;

wherein said third means is a burner cup having a substantially axially symmetric shape, an axis being preferably essentially orthogonal to the covering element; and at least one securing device adapted to connect said flame divider means to one or both of said covering element and said gas burner.

16. The cooking top according to claim 15, wherein said flame divider means includes a housing means adapted to house said at least one securing device;

said third means includes a supporting means;

wherein said housing means includes a hole that is coaxial to said semi-permeable element;

said securing device includes a first part being substantially discoidal in shape and a second part being substantially tubular in shape; and a connection of said flame divider means to one or both of said cooking top and said at least one gas burner being provided through interposition of a portion of said flame divider means between said supporting means and said first part of said securing device.

17. A cooking top comprising:

at least one gas burner which can be used with at least one fuel gas;

flame divider means associated with said at least one gas burner, said flame divider means including at least one semi-permeable element having a substantially annular shape, said semi-permeable element being a micro-perforated sheet that is permeable to gaseous substances including said fuel gas and to any mixture including said fuel gas and air, and being substantially impermeable to liquid substances, wherein said flame divider means allows a flame generated by a combustion of the fuel gas and the air to exit through the semi-permeable element;

wherein said flame divider means includes housing means adapted to house at least one securing device, said at least one securing device having a first part being substantially discoidal in shape and a second part being substantially tubular in shape, said housing means having an opening that is coaxial to said semi-permeable element;

a connection of said flame divider means to one or both of said cooking top and said at least one gas burner being provided through interposition of a portion of said flame divider means between a supporting means and said first part of said securing device; and wherein said securing device further includes flow diverter means, said flow diverter means consisting of one or both of a flared surface and a gradually decreasing section of said second part of said securing device.

18. The cooking top according to claim 17, wherein said securing device is a removable device adapted to grant access inside the gas burner for maintaining said gas burner and to allow one or both of said flame divider means and said semi-permeable element to be removed.

19. A cooking top comprising:

at least one gas burner for use with at least one fuel gas;

first means including an injector adapted to supply said fuel gas or a mixture thereof with air;

second means including a Venturi element;

third means adapted to mix and/or provide combustion of includes fuel gas and includes air supplied by said first and second means;

flame divider means associated with said at least one gas burner, said flame divider means including at least one semi-permeable element having a substantially annular shape, said semi-permeable element being a micro-perforated sheet that is permeable to gaseous substances, including the fuel gas and a mixture including said fuel gas and the air, and being substantially impermeable to liquid substances, wherein the flame divider means allows a flame generated by the combustion of the fuel gas and the air to exit through the semi-permeable element;

diverter means adapted to divert any liquid substances coming from said semi-permeable element toward areas wherein said liquid substances cannot hinder the operation of said gas burner, said diverter means consisting of die-cast or forged profiles made of sheet-metal, brass, cast-iron or steel having perforations adapted to allow gaseous substances to flow through to supply said gas burner and having a diameter adapted to prevent said flow from suffering high load losses.

* * * * *

UNITED STATES PATENT AND TRADEMARK OFFICE

CERTIFICATE OF CORRECTION

PATENT NO. : 8,662,069 B2
APPLICATION NO. : 11/992694
DATED : March 4, 2014
INVENTOR(S) : Alberto Gasparini et al.

It is certified that error appears in the above-identified patent and that said Letters Patent is hereby corrected as shown below:

In the Claims:
Claim 19, col. 12, line 20 should read:
~~includes fuel gas and includes air supplied by said first~~
the fuel gas and the air supplied by said first Signed and Sealed this
Third Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,662,069 B2
APPLICATION NO. : 11/992694
DATED : March 4, 2014
INVENTOR(S) : Gasparini et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 203 days.

Signed and Sealed this
Twenty-ninth Day of September, 2015

Michelle K. Lee

Michelle K. Lee
*Director of the United States Patent and Trademark Office*